United States Patent [19]

Benkelman et al.

[11] 4,335,551

[45] Jun. 22, 1982

[54] SKYLIGHT CONSTRUCTION AND METHOD OF MAKING SAME

[75] Inventors: William D. Benkelman, Bloomfield Hills, Mich.; George C. Carlyon, Tampa, Fla.

[73] Assignee: Dayco Corporation, Dayton, Ohio

[21] Appl. No.: 162,989

[22] Filed: Jun. 25, 1980

Related U.S. Application Data

[62] Division of Ser. No. 921,658, Jul. 3, 1978, Pat. No. 4,242,849.

[51] Int. Cl.[3] ..... E04B 7/18

[52] U.S. Cl. ..... 52/200; 52/790

[58] Field of Search ..... 52/200, 788, 790, 309.1

[56] References Cited

U.S. PATENT DOCUMENTS

| | | | |
|---|---|---|---|
| 2,918,023 | 12/1959 | Bettcher | 52/200 X |
| 3,127,699 | 4/1964 | Wasserman | 52/200 X |
| 3,934,383 | 1/1976 | Perry et al. | 52/200 |
| 4,223,493 | 9/1980 | Moench et al. | 52/200 |

FOREIGN PATENT DOCUMENTS

| | | | |
|---|---|---|---|
| 2746495 | 4/1979 | Fed. Rep. of Germany | 52/200 |
| 2802180 | 7/1979 | Fed. Rep. of Germany | 52/200 |
| 2923765 | 12/1979 | Fed. Rep. of Germany | 52/200 |
| 7700507 | 7/1978 | Netherlands | 52/200 |

OTHER PUBLICATIONS

The Condensed Chemical Dictionary, eight Edition, Van Nostrand Reinhold Co., 1971, p. 705.

*Primary Examiner*—Carl D. Friedman

*Attorney, Agent, or Firm*—Joseph V. Tassone

[57] ABSTRACT

A skylight construction and method of making same are provided wherein such construction comprises, a support, an outer sheet made of a light-transmitting material and having a peripheral portion adjoining the support, and an inner structure made of a light-transmitting material and having a peripheral edge portion attached to the support defining a first air space between the outer sheet and the structure with the inner structure comprising a pair of inner sheets each made of a light-transmitting material and with the inner sheets being held in spaced relation defining a second air space therebetween such that the sheets and first and second air spaces enable provision of the skylight construction having minimum weight yet providing minimum heat loss in winter and minimum heat gain in summer.

10 Claims, 4 Drawing Figures

SKYLIGHT CONSTRUCTION AND METHOD OF MAKING SAME

This is a division, of application Ser. No. 921,658, filed July 3, 1978, U.S. Pat. No. 4,242,849.

BACKGROUND OF THE INVENTION

Skylights are widely used in all types of building constructions; however, inherently the skylights proposed heretofore have been deficient primarily due to their poor thermal insulation characteristics whereby such skylights have resulted in substantial heat loss from within each building associated therewith during winter seasons and substantial heat gain during summer seasons. Another deficiency of many of the previously proposed skylights is that each of such skylights is comparatively heavy and requires that a supporting curb and adjoining roof structure associated therewith be considerably stronger, resulting in greater costs.

SUMMARY

It is a feature of this invention to provide a skylight construction which overcomes or minimizes the above-mentioned deficiencies in that such skylight construction is of minimum weight and provides minimum heat loss in winter and minimum heat gain in summer.

Another feature of this invention is to provide a skylight construction of the character mentioned made entirely of synthetic plastic material including synthetic plastic adhesive means holding same together.

Another feature of this invention to provide a skylight construction which is self-curbing in that it may be attached directly to a so-called curb of a skylight support structure without requiring additional transition components therebetween.

Another feature of this invention is to provide a skylight construction of the character mentioned employing at least three sheets of synthetic plastic material in the form of polycarbonate material to define a plurality of at least two air spaces wherein the sheets and air spaces have improved thermal insulating properties.

Another feature of this invention to provide a skylight construction of the character mentioned comprising a support and an outer sheet made of a light-transmitting material wherein the support and outer sheet are defined as a single-piece structure and the light-transmitting material is in the form of a polycarbonate.

Another feature of this invention to provide an improved method of making a skylight construction of the character mentioned.

Accordingly, it is an object of this invention to provide an improved skylight construction and method of making same having one or more of the novel features set forth above or hereinafter shown or described.

Other features, objects, details, uses, and advantages of this invention will be readily apparent from the embodiments thereof presented in the following specification, claims, and drawing.

BRIEF DESCRIPTION OF THE DRAWING

The accompanying drawing shows present preferred embodiments of this invention, in which.

DESCRIPTION OF ILLUSTRATED EMBODIMENT

Figure 1:
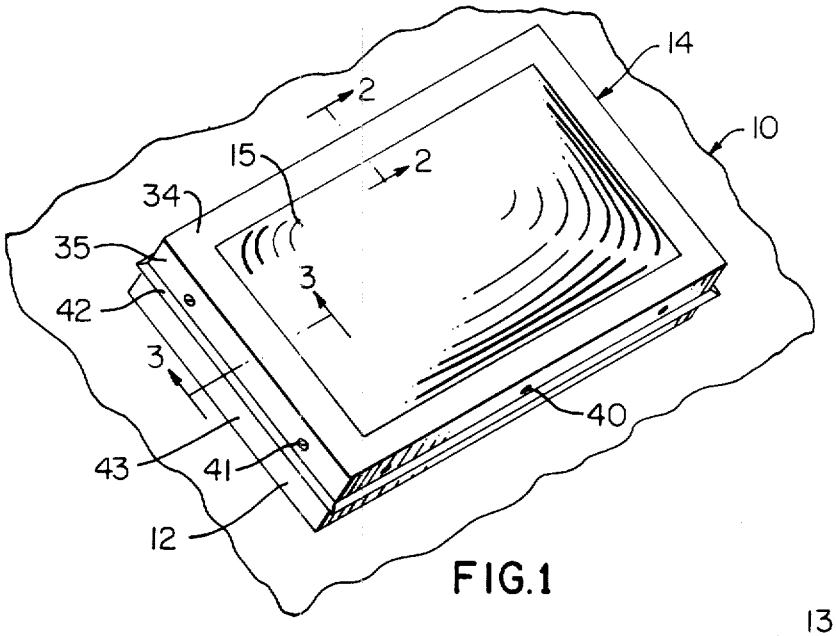
FIG. 1 is a perspective view showing a fragmentary portion of a roof with an upstanding curb which surrounds an opening in the roof and illustrating one exemplary embodiment of a skylight construction of this invention.
Figure 2:
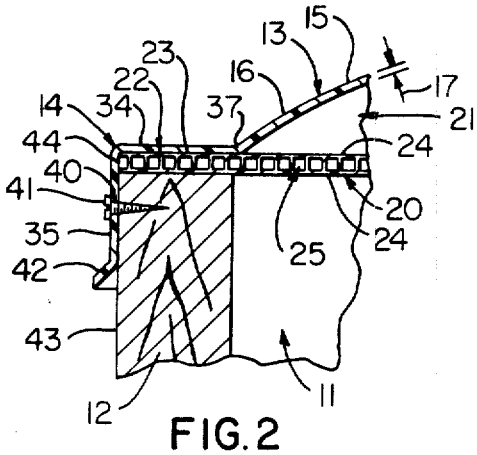
FIG. 2 is a fragmentary cross-sectional view taken essentially on the line 2—2 of FIG. 1.
Figure 3:
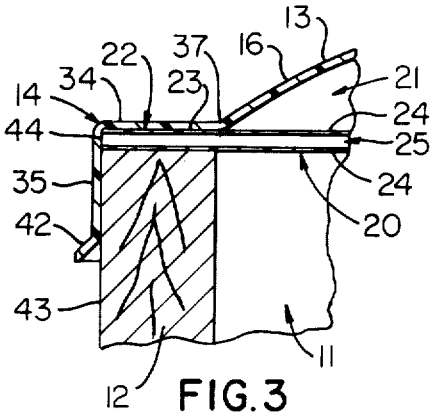
FIG. 3 is a fragmentary cross-sectional view taken essentially on the line 3—3 of FIG. 1.

Reference is now made to FIG. 1 of the drawing which illustrates an exemplary roof 10 which may be of any suitable construction known in the art and such roof has an opening 11 (FIGS. 2-3) therein which is surrounded by the usual curb structure or curb 12, a fragmentary upper portion of which is illustrated in the drawing. The curb 12 is made in accordance with techniques known in the art and is sealed to the remainder of the roof 10 in an non-leaking manner providing a non-leaking seal around the opening 11 in such roof. The upper portion of the curb 12 is shown by cross-hatching in th drawing as being made of wood; however, it will be appreciated that such curb may be made of any suitable material employed for this purpose.

The curb 12 has one exemplary embodiment of a skylight construction of this invention attached thereover which is designated generally by the reference numeral 13 and the skylight construction 13 is preferably made entirely of non-metallic material in the form of synthetic plastic material such as polycarbonate and as will be described in more detail subsequently. The skylight construction 13 comprises a support 14 and an outer sheet 15 in the form of an outwardly convex or domed sheet which is made of a light-transmitting material and has a peripheral portion 16 adjoining the support 14. Although the support 14 and outer sheet 15 may be made of a plurality of components or parts and of different materials the support 14 and outer sheet 15 with peripheral portion 16 are preferably made of the same material as a single-piece structure and substantially of the same thickness 17 throughout.

Figure 4:
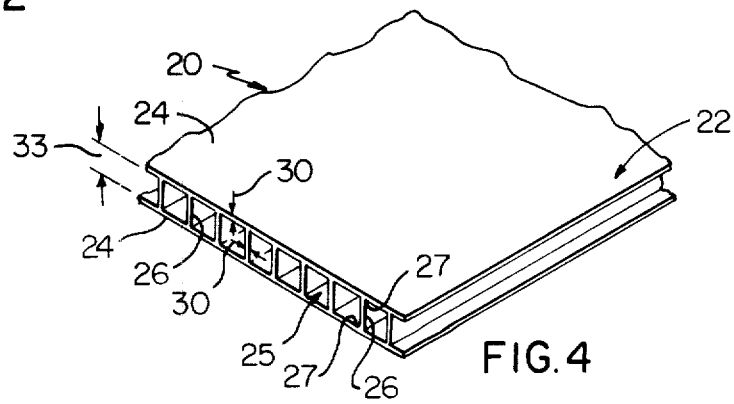
FIG. 4 is a fragmentary perspective view of an inner structure comprising the skylight construction of FIG. 1 in the form of a sandwich construction having an integral air space defined between a pair of parallel sheets of light-transmitting material.

The skylight construction 13 also has an inner structure designated generally by reference numeral 20 which is shown in more detail in FIG. 4, and inner structure 20 is attached to the support 14 defining a first air space 21 between the inner structure 20 and outer sheet 15. The inner structure 20 has a peripheral portion 22 which has a peripheral outline which corresponds to the configuration of the support 14; and, the peripheral portion 22 is attached to the support by suitable non-metallic means in the form of synthetic plastic adhesive means, such as, a layer of adhesive 23 which is compatible with the material comprising the inner structure 20 and the support 14. Accordingly, it is seen that the inner structure 20 is adhesively bonded against the inside peripheral surface portion of the support 14.

As best seen in FIG. 4 of the drawing the inner structure 20 comprises a pair of identical inner sheets each designated by the reference numeral 24 and sheets 24 are fixed together in spaced relation in a manner to be described in detail subsequently to define a second air space 25 between the sheets 24. The sheets 15 and 24 together with the first and second air spaces 21 and 25 respectively enable the provision of the overall skylight construction 13 having minimum weight yet providing minimum heat loss in winter and minimum heat gain in summer.

The sheets 24 of the inner structure 20 have means holding or fixing same in spaced relation and preferably in spaced parallel relation and such holding means is in the form of plurality of substantially identical ribs 26. Each rib 26 has opposite end edges 27 which adjoin and are fixed to sheets 24 and the ribs 26 and sheets 24 are preferably of the same thickness which is designated generally by the reference numeral 30. The thickness 30 of sheets 24 and ribs 26 is substantially less than the thickness 17 of the outer sheet 15 and may range between one tenth and one fifth the thickness 17. The sheets 24 may be held together by ribs 26 employing any suitable adhesive means, or the like, between the edges 27 of each rib 26 and the sheet 24 including heat fusion, or the like. However, sheets 24 and ribs 26 are preferably made as a single-piece structure by any suitable process such as extrusion through a suitable extrusion die, whereby the edges 27 of each rib 26 flow smoothly with and are defined as an integral part of the sheets 24 on opposite sides thereof and define an air space 25 between sheets 24.

As previously indicated the outwardly convex outer sheet 15 and the support 14 adjoin along the peripheral portion 16 of such sheet 15; and the support 14, peripheral portion 16, and sheet 15 are defined as a single-piece construction made of synthetic plastic material in the form of a polycarbonate. The support 14 may have any suitable cross-sectional configuration which in this example is a substantially L-shaped configuration defined by a pair of legs 34 and 35 adjoined at a common bight. One of the legs, shown as the leg 34, has the outer sheet 15 and in particular the peripheral portion 16 of such outer sheet blended smoothly therewith on a smooth radius 37; and, the other leg 35 is disposed substantially perpendicular to the leg 34.

The leg 35 has a plurality of openings 40 extending therethrough each of which is particularly adapted to have a suitable fastener such as a fastening screw 41 extending therethrough for attachment thereof to the tubular structure on curb 12. The leg 35 also has an outwardly flaring skirt 42 which flares or diverges outwardly away from the main body of the skylight construction 13, and such outwardly flaring skirt 42 is particularly adapted to divert rain, and the like, away from the outside surface of the curb 12.

The leg of the support 14 and in particular the leg 35 of the L-shaped construction defining such support is dimensioned so that it fits in close proximity to the peripheral outside surface 43 of the curb 12. Accordingly, it will be appreciated that in making the skylight construction 13 the outer sheet 15 including its integral peripheral portion 16 and support 14 are formed based upon the dimensions of the curb 12. Once this single-piece outer structure has been completed the substantially flat inner structure 20 is cut from a sheet of stock material comprising same so that it has a peripheral edge 44 which fits snugly within the inside surface of the leg 35 whereupon the structure 20 may have its peripheral portion 22 bonded by adhesive means 23 against the inside surface of the leg portion 34 of support 14.

By making the entire skylight construction 13 of synthetic plastic material, it will be appreciated that such skylight construction will be liquid-tight and free of any tendencies to sweat, or the like.

The thickness 30 of the sheets 24 and ribs 26 of inner structure 20 and the thickness 33 of the air space 25 between sheets 24 may be any suitable thickness depending upon the application of the skylight construction. In one application of this invention an all polycarbonate skylight construction 13 had overall dimensions in plan view of roughly 14 inches by 28 inches. The one-piece outer sheet 15 and support 14 were $\frac{1}{8}$ inch thick and the thickness of the air space 21 at the apex of the outwardly convex sheet 15 was about 3 inches. The thickness 30 of the inner sheets 24 and ribs 26 was about 0.030 inch with the thickness 33 of the air space 25 being roughly $\frac{1}{4}$ inch. Nevertheless, it is to be understood the thickness of each of the various sheets and the thickness of each air space may be varied as required to provide the desired performance in an overall skylight construction 13.

In this disclosure of the invention the outer sheet 15 is shown as having an outwardly convex configuration of a particular shape; however, it is to be understood that the particular outwardly convex shape may be varied as desired. Preferably such shape is a smooth curve viewed on any crosssectional plane perpendicular to a plane adjoining the bottom surface of the outwardly flared skirt. In addition, in making the outer sheet 15 with its peripheral portion 16 and integral support 14, all portions 14–16 are preferably blended together on smooth radii each of generous length to thereby avoid stress concentrations between adjoining portions.

It will also be seen that in this disclosure of the invention the inner structure 20 is substantially flat and defined by a pair of flat sheets disposed in spaced parallel relation. However, it is to be understood that the inner structure 20 may also have a contoured configuration which may or may not correspond to the configuration of the outer sheet 15; and, regardless of whether structure 20 is flat or contoured it is defined by a pair of sheets 24 of light-transmitting material joined by ribs 26 also made of light-transmitting material with the second previously described air space 25 between sheets 24.

As previously indicated, the sheets 24 and ribs 26 together with the single-piece outer sheet 15, peripheral portion 16, and support 14 are preferably made of synthetic plastic material in the form of polycarbonate. Although any suitable polycarbonate may be used for this purpose one example of a polycarbonate which may be used is made by the Rohm and Haas Co. of Philadelphia, Pa., 19105, and sold in sheet form under the registered trademarks "Plexiglas" and "Tuffak." Another example of a polycarbonate which may be used is manufactured by the General Electric Co. of Pittsfield, Mass., 01201 and sold in sheet form under the registered trademarks "Protect-A-Glaze" and "Lexan." Similarly the inner structure 20 may be made from flowable or extrudable synthetic plastic material ordinarily utilized to make the above-described sheets and extruded through a suitable die apparatus to define the single-piece unitary structure 20.

The sheets 15 and 24 are made of light-transmitting synthetic plastic material such that all the desired light can pass therethrough into the building construction yet there is minimum heat loss in winter and minimum heat gain in summer due to the coaction of sheets 15 and 24 and air spaces 21 and 25. It will be appreciated that the plastic material employed for each sheet may be transparent or translucent or the sheets may be any combination of transparent and translucent material. In addition, glare control or tinted sheets may be used as well as sheets having either smooth or roughened surfaces.

While present exemplary embodiments of this invention, and methods of practicing the same, have been illustrated and described, it will be recognized as this invention may be otherwise variously embodied and practiced within the scope of the following claims.

What is claimed is:

1. In a skylight comprising; a support; an outer sheet made of a light-transmitting material and having a peripheral portion adjoining said support; and an inner structure made of light-transmitting material and having a peripheral edge portion attached to said support defining a first air space between said outer sheet and said structure; the improvement wherein said inner structure comprises a pair of inner sheets each made of a light-transmitting material, said inner sheets being held in spaced relation defining a second air space therebetween, said sheets and first and second air spaces enabling provision of said skylight construction having mininmum weight yet providing minimum heat loss in winter and minimum heat gain in summer, said inner sheets being made of synthetic plastic material, and means holding said inner sheets to define said second air space therebetween, said holding means comprising a plurality of substantially identical spaced parallel ribs extending between said inner sheets and fixing same together in spaced parallel relation.

2. In a skylight construction comprising; a support; an outer sheet made of a light-transmitting material and having a peripheral portion adjoining said support; and an inner structure made of light-transmitting material and having a peripheral edge portion attached to said support defining a first air space between said outer sheet and said structure; the improvement wherein said inner structure comprises a pair of inner sheets each made of a light-transmitting material, said inner sheets being held in spaced relation defining a second air space therebetween, said sheets and first and second air spaces enabling provision of said skylight construction having minimum weight yet providing minimum heat loss in winter and minimum heat gain in summer, each of said sheets being made of polycarbonate, and means holding said inner sheets to define said second air space therebetween, said inner sheets and holding means being made of the same polycarbonate and as a single piece structure.

3. In a skylight construction as set forth in claim 2 the further improvement in which said holding means comprises a plurality of substantially identical spaced parallel ribs extending between said inner sheets and fixing same together.

4. In a skylight construction as set forth in claim 3 the further improvement in which said ribs are continuous surface ribs disposed perpendicular to said inner sheets, said ribs having substantially the same thickness as said inner sheets.

5. In a skylight construction as set forth in claim 4 the further improvement in which said thickness of said inner sheets and ribs is a small fractional part of the thickness of said outer sheet.

6. In a skylight construction as set forth in claim 5 the further improvement in which said inner sheets and ribs are in the form of extruded sheets and ribs and said holding means comprise defining said sheets and ribs during the extrusion process as said single-piece structure.

7. In a skylight construction as set forth in claim 2 the further improvement in which said outer sheet and support are defined as a single-piece structure.

8. In a skylight construction as set forth in claim 7 the further improvement in which said support has an L-shaped cross-sectional outline defined by a pair of legs adjoined at a common bight, one of said legs having said outer sheet blending smoothly therewith and the other of said legs being disposed perpendicular to said one leg.

9. In a skylight construction as set forth in claim 8 the further improvement in which said other leg has a plurality of openings therethrough for attaching thereof to a tubular curb structure extending from a roof and surrounding an opening in said roof.

10. In a skylight construction as set forth in claim 9 the further improvement in which said other leg has a lower edge provided with an outwardly flared skirt and said outer sheet has an outwardly convex dome-like configuration.

* * * * *